US005458506A

United States Patent [19]

Yamaguchi et al.

[11] Patent Number: 5,458,506

[45] Date of Patent: Oct. 17, 1995

[54] FLEXIBLE BOARD ELECTRICAL CONNECTOR

[75] Inventors: Tomisaburo Yamaguchi; Ryuichi Takayasu, both of Tokyo, Japan

[73] Assignee: Hirose Electric Co., Ltd., Tokyo, Japan

[21] Appl. No.: 219,458

[22] Filed: Mar. 29, 1994

[30] Foreign Application Priority Data

| | | | |
|---|---|---|---|
| Apr. 2, 1993 | [JP] | Japan | 5-021529 U |
| Nov. 18, 1993 | [JP] | Japan | 5-311078 |
| Feb. 3, 1994 | [JP] | Japan | 6-030801 |

[51] Int. Cl.[6] ..... H01R 9/07

[52] U.S. Cl. ..... 439/495; 439/67

[58] Field of Search ..... 439/492–499, 439/326–329, 341, 347, 67, 77

[56] References Cited

U.S. PATENT DOCUMENTS

| | | | |
|---|---|---|---|
| 3,090,028 | 5/1963 | Hall et al. | 439/495 |
| 4,477,137 | 10/1984 | Ayer | 439/495 |
| 4,718,859 | 1/1988 | Gardner | 439/499 |
| 4,768,969 | 9/1988 | Bauer et al. | 439/499 |

FOREIGN PATENT DOCUMENTS

| | | | |
|---|---|---|---|
| 3822980 | 1/1990 | Germany | 439/499 |

*Primary Examiner*—David L. Pirlot
*Attorney, Agent, or Firm*—Kanesaka & Takeuchi

[57] ABSTRACT

A flexible board electrical connector includes a housing having an opening on an upper corner and a plurality of contact channels on the opening; a plurality of contact elements fitted in the contact channels such that spring contact portions thereof exposed in the opening; a pressure member attached to the housing for rotation between a closed position where it is brought into contact with the contact elements and an open position where it is apart from the contact elements; and a pressure edge provided on the pressure member at such a position that when the pressure member is in the open position, it is in a first position outside from a line including the turning center of the pressure member and the contact portion of a contact element and when the pressure member is turned to the closed position, it is moved to a second position inside from the line so that once the pressure member is turned to the closed position, the pressure member is urged to the closed position by reactive forces of the contact portions and the flexible board.

7 Claims, 19 Drawing Sheets

FLEXIBLE BOARD ELECTRICAL CONNECTOR

BACKGROUND OF THE INVENTION

1. Field of the Invention

The present invention relates to electrical connectors for connecting flexible boards to circuit boards.

2. Description of the Related Art

Japanese patent application Kokoku No. 3-051,257 discloses a so-called forceless connector for connecting a flexible board to a circuit board such as shown FIGS. 1 and 2. The connector includes a housing 51 having an opening at the upper right-hand corner. A pressure member 52 is attached to the housing 51 for rotation to cover the opening. The pressure member 52 is rotatable clockwise to a closed position as shown in FIG. 2 such that the front concave surface 53 of the pressure member 52 slides on the convex surface 54 of the housing 51. When the pressure member 52 rotates to the closed position, a latch claw 56 engages a latch shoulder 57 of the housing 51 to hold the pressure member in the closed position.

A number of contact elements 55 are arranged within the housing 51 in the direction perpendicular to the paper sheet. A contact portion 58 of each contact member 55 is bent in a U-shaped form so as to provide a spring property and has a front end extending diagonally upwardly toward the pressure member 52. A connection portion 59 is bent in an L-shaped form so as to extend downwardly through the housing 51 and an aperture P1 of a circuit board P.

In operation, the pressure member 52 is turned to the open position, and a flexible board F is inserted into the connector such that it slides on the lower surface of the pressure member 52 as shown in FIG. 1. Then, the pressure member 52 is turned clockwise to the closed position as shown in FIG. 2. Consequently, the pressure member 52 presses the flexible board F against the front ends 58 of the contact elements 55 so that the circuit conductors on the lower side of the flexible board F are brought into contact with the corresponding contact elements 55 while the latch claw 56 engages the latch shoulder 57 to hold the connection between the flexible board F and the contact elements 55.

In the above connector, however, the thickness of the pressure member 52 between the center of rotation of the pressure member 52 and the front ends 58A contact elements 55 increases toward the outside of the connector so that the pressure member 52 can open if the engagement between the latch claw 56 and the latch shoulder 57 is incomplete.

In order to prevent such a problem, the latch claw and shoulder must be sufficiently large to ensure the engagement. Such large latch claw and shoulder provided on the side of the connector make the connector itself larger.

Japanese patent application Kokoku No. 4-33671 discloses another forceless-type electrical connector such as shown in FIGS. 3 and 4. A housing 61 has an opening on the upper left corner. A pressure member 62 is supported by the housing 61 for rotation about the axis 63. A cylindrical portion 64 of the pressure member 62 engages a concave surface 65 of the housing 61 in sliding relation and is rotatable clockwise to the closed position as shown in FIG. 4.

A number of contact elements 66 are disposed within the housing 61 in the direction perpendicular to the paper. An contact portion 67 of each contact element 66 is bent in the U-shaped form so as to provide a spring property, with its tip facing toward the pressure member 62. A connection portion 68 extends downwardly through the housing 61 to be inserted into an aperture of a circuit board (not shown).

The pressure member 62 has two flat surfaces 69 and 70 connected to each other at a certain angle. When the pressure member 62 is turned to the closed position in FIG. 4, the upper flat surface 70 comes into contact with the flexible board F. The distance d1 between the axis 63 and the lower flat surface 69 is made less than the distance d2 between the axis 63 and the upper flat surface 70.

In operation, the pressure member 62 is turned counterclockwise to the open position, and a flexible board F is inserted into a space between the pressure member 62 and the contact portions 67 of contact elements 66 as shown in FIG. 3. Then, the pressure member 62 is turned clockwise to the closed position so that the upper flat surface 70 presses the flexible board F against the contact portions 67 of the contact elements 66 to thereby bring the electrical circuit of the flexible board F into contact with the contact elements 66 as shown in FIG. 4. The tips of the contact elements 66 contacting the flexible board F are located below the axis 63 so that the tips exert a reactive force on the pressure member 62 via the flexible board F tending to turn the pressure member 62 clockwise. Consequently, once turned to the closed position, the pressure member 62 is hardly opened, thus holding the flexible board F reliably.

However, the flexible board F contacts the contact elements 66 at a point as shown in FIG. 4 so that when the pressure member 62 is being opening, the flexible board F contacts the pressure member 62 at an edge formed by the adjoining upper and lower flat surfaces 69 and 70. Consequently, in order to hold the flexible board in proper contact with the contact elements 66, it is necessary that the contact points and edge be close in the insertion direction of the flexible board.

The aforementioned distances d1 and d2 depend on the thickness of the flexible board F. In order to assure proper insertion of the flexible board regardless of the thickness, it is necessary to keep the difference of the distances d2 and d1, or (d2–d1), constant, while in order to make the connector compact, it is necessary to reduce the distance d2. If the distance d2 is made very small, however, the distance d1 becomes too small to provide sufficient strength. As the difference (d2–d1) is made small while keeping the constant value, the edge between the flat surfaces 69 and 70 becomes so close to the axis 63 that the moment of a force on the pressure member 62 becomes too small to hold the pressure member 62. Other words, it is very difficult to produce a satisfactory moment in the clockwise direction for the pressure member 62 because of the limited shape, size, and tolerance of contact elements and the pressure member, thus failing to provide proper contact between the connector and the flexible board F. Especially, the contact elements are made by deforming metal pins, thus producing many shaping errors having adverse effects.

In addition, the middle portion of the pressure member which is supported by the housing at opposite ends for rotation tends to be bent upwardly by a force from the bottom, thus changing the contact pressure. This problem becomes worse as the number of contact elements increases.

Japanese UM patent application Kokai No. 4-61,883 discloses a still another conventional forceless electrical connector such as shown in FIGS. 5–7. An elongated substantially rectangular housing 71 has an opening on the upper left corner. A pressure member 72 is attached to the housing 71 for rotation about shaft portions 73 extending in the longitudinal direction of the housing 71. A cylindrical sliding surface 74 is formed on the pressure member 72 so as to slide on a guiding surface 75 of the opening so that the pressure member 72 is rotatable about the axis 76 between two positions as shown in FIGS. 6 and 7.

A number of contact elements 77 are arranged in the housing 71 in the longitudinal direction of the housing 71. A spring contact portion 78 has a U-shaped form and has a front portion facing the pressure member 72. A connection portion 79 extends downwardly through the housing 71 and then to the right side to be inserted into an aperture of a circuit board (not shown).

A pair of flat surfaces 40 and 41 are provided on the pressure member 72 and connected to each other at an angle. When the pressure member 72 is turned from the open position in FIG. 6 to the closed position in FIG. 7, the upper flat surface 41 is brought into contact with the flexible board F. The distance d3 between the upper flat surface 41 from the axis 76 is made larger than the distance d4 between the lower flat surface 80 and the axis 76.

In operation, the pressure member 72 is turned counterclockwise about the axis 76 to the open position, and a flexible board F is inserted into a space between the pressure member 72 and the contact portions 78 of contact elements 77 as shown in FIG. 6. The pressure member 72 is then turned clockwise to the closed position so that the upper flat surface 41 presses the flexible board F to the right as shown in FIG. 7. Consequently, the flexible board F is pressed against the contact portions 78 of contact elements 77 so that the circuit conductors of the flexible board F are brought into contact with the contact elements 77.

When the pressure member 72 is turned counterclockwise to the open position, it abuts against a shoulder 82 of the housing 71 so that the rotation of the pressure member 72 beyond the shoulder 82 are prevented. The torque applied to the pressure member 72 is proportional to the arm length L from the shoulder 42. The arm length L is generally set greater than the distance T between the shoulder 42 and the axis 76, so that the torque applied to the pressure member 72 becomes large.

As a result, the shaft portions 73 of pressure member 72 or the bearing portions of housing 71 can be broken, and the pressure member 72 comes off from the housing 71. The smaller the connector, the higher the frequency with which such accident occurs.

SUMMARY OF THE INVENTION

Accordingly, it is an object of the invention to provide a flexible board electrical connector which requires no latch claw and shoulder provided on the side of the connector.

It is another object of the invention to provide a flexible board electrical connector which minimizes poor contact because of errors in dimension and location of respective parts and warping of the pressure member.

It is still another object of the invention to provide a flexible board electrical connector which is highly resistance to the torque for turning the pressure member beyond the open position.

According to an aspect of the invention there is provided a flexible board electrical connector which includes a housing having an opening on an upper corner and a plurality of contact channels on the opening; a plurality of contact elements fitted in the contact channels such that spring contact portions thereof exposed in the opening; a pressure member attached to the housing for rotation between a closed position where it is brought into contact with the contact elements and an open position where it is apart from the contact elements; and a pressure edge provided on the pressure member at such a position that when the pressure member is in the open position, it is in a first position outside from a line including a turning center of the pressure member and the contact portion of a contact element and when the pressure member is turned to the closed position, it is moved to a second position inside from the line so that once the pressure member is turned to the closed position, with the pressure edge pressing a flexible board against the contact portions, the pressure member is urged to the closed position by the contact portions via the flexible board.

As the pressure member is turned, the pressure edge is moved from the first position outside from the line including the turning center of the pressure member and the contact portion of a contact element to the second position inside from the line. Consequently, the pressure member is held in the closed position despite the reactive force by the contact portions via the flexible board. That is, the pressure member is not moved beyond the line unless a force exceeding the reactive force is applied to the pressure member, thereby holding the pressure member in place without any separate latch device.

According to another aspect of the invention, the housing is provided with support portions so that the pressure edge exerts a presses on the flexible board at a position between the contact portions of contact elements and the support portions of the housing, thereby minimizing adverse effects of errors in shape and location of respective parts and warping deformation of the flexible board.

When the flexible board is inserted completely into a space between the contact portions of contact elements and the pressure member, its front portion is pushed upwardly by the support portions of the housing.

When the pressure member is turned toward the closed position, the pressure edge abuts on the upper surface of the flexible board. At this point, the flexible board is supported by the contact portions of contact elements and the support portions of the housing. When the pressure member is further turned to bring it to the closed position, the pressure edge presses downwardly the flexible board at a position between the contact portions and the support portions. Consequently, the distance between the contact portions and the support portions is so large that it is possible to minimize the difference in distance from the axis between the two flat surfaces and thus the connector itself. The contact pressures produced by the deformation are minimized so that the variations in reliability due to location and dimensional errors is minimized.

According to still another aspect of the invention, the pressure member is provided with an abutting portion for abutting the housing when the pressure member is turned beyond a predetermined angle.

When the pressure member is turned to the open position, the abutting face abuts on the housing and receives a reactive force from the housing. The abutting location between the abutting portion and the housing moves away from the axis with the increasing angles of rotation of the pressure member.

Thus, when the operator continues to apply a torque to the pressure member after the abutting, the arm length of the torque is made so as to be decreased to minimize the torque, thereby preventing damage to the support portion of the pressure member.

The above and other objects, features, and advantages of the invention will be more apparent from the following description when taken in conjunction with the accompanying drawings.

DESCRIPTION OF THE PREFERRED EMBODIMENT

Figure 1:
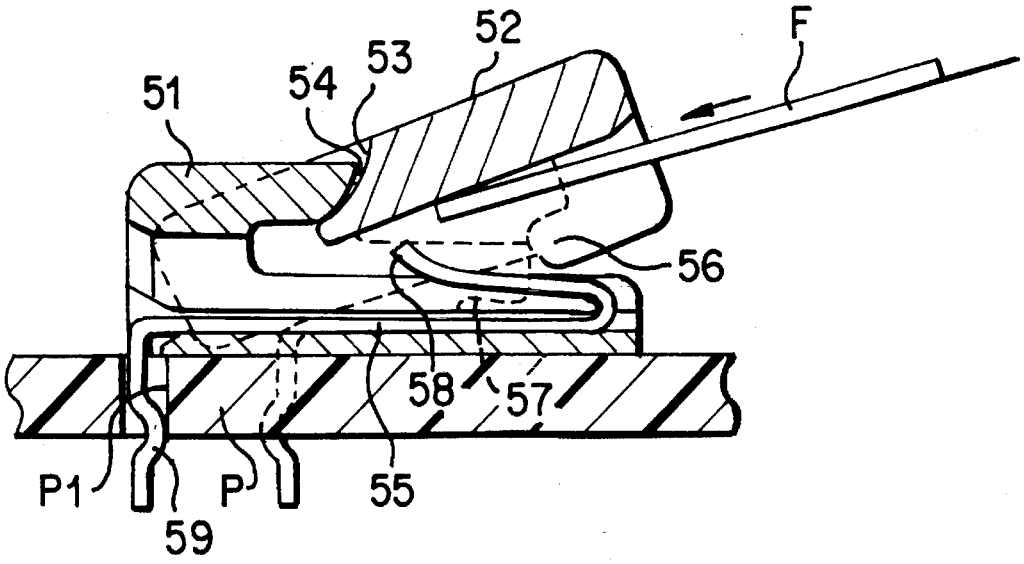
FIG. 1 PRIOR ART
FIG. 1 is a sectional view of a conventional electrical connector with the pressure member opened.
Figure 2:
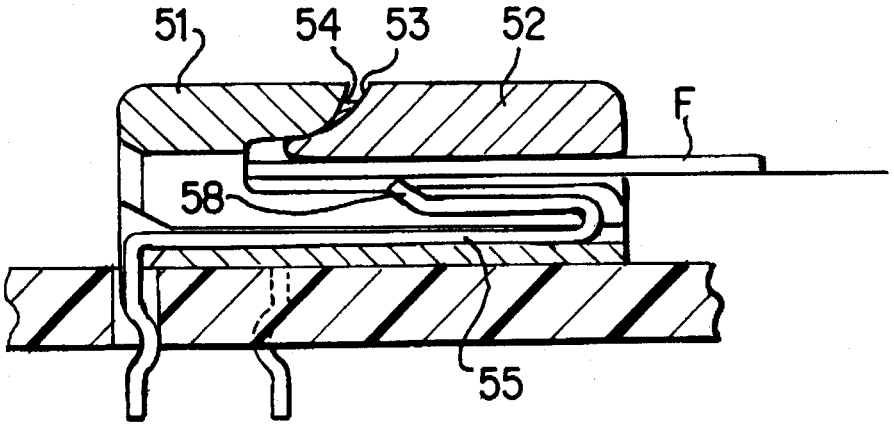
FIG. 2 PRIOR ART
FIG. 2 is a sectional view of the electrical connector of FIG. 1 with the pressure member closed.
Figure 4:
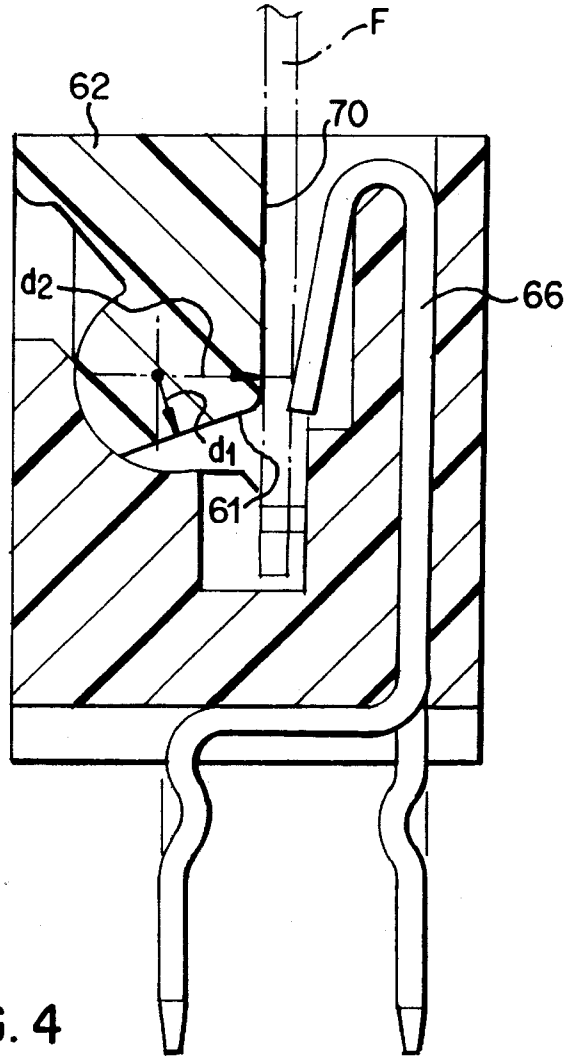
FIG. 4 PRIOR ART
FIG. 4 is a section view of the conventional electrical connector of FIG. 3 wherein the pressure member is in the closed position.
Figure 3:
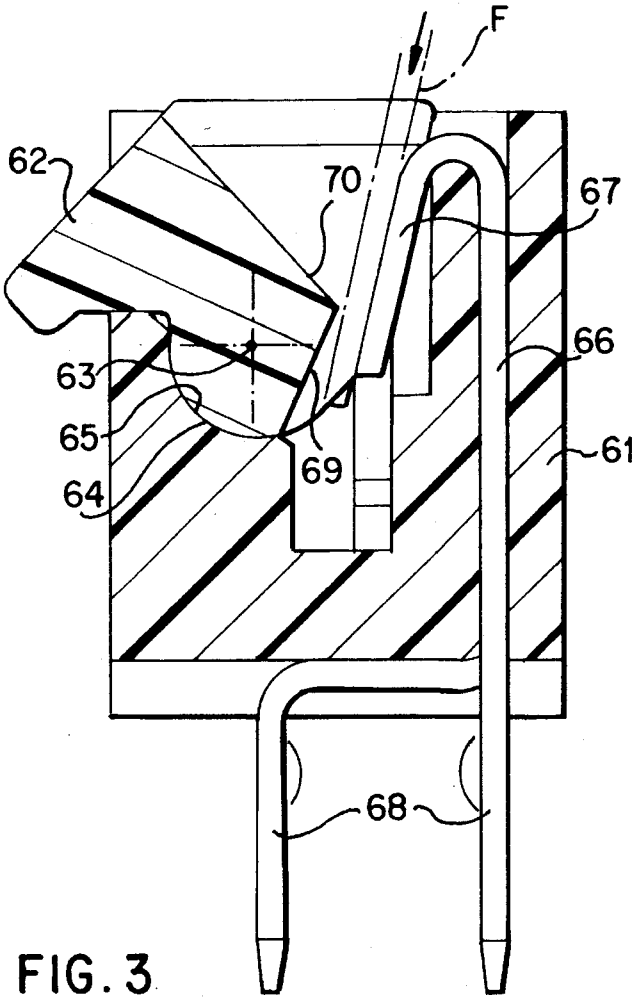
FIG. 3 PRIOR ART
FIG. 3 is a sectional view of another conventional electrical connector wherein the pressure member is in the open position.
Figure 5:
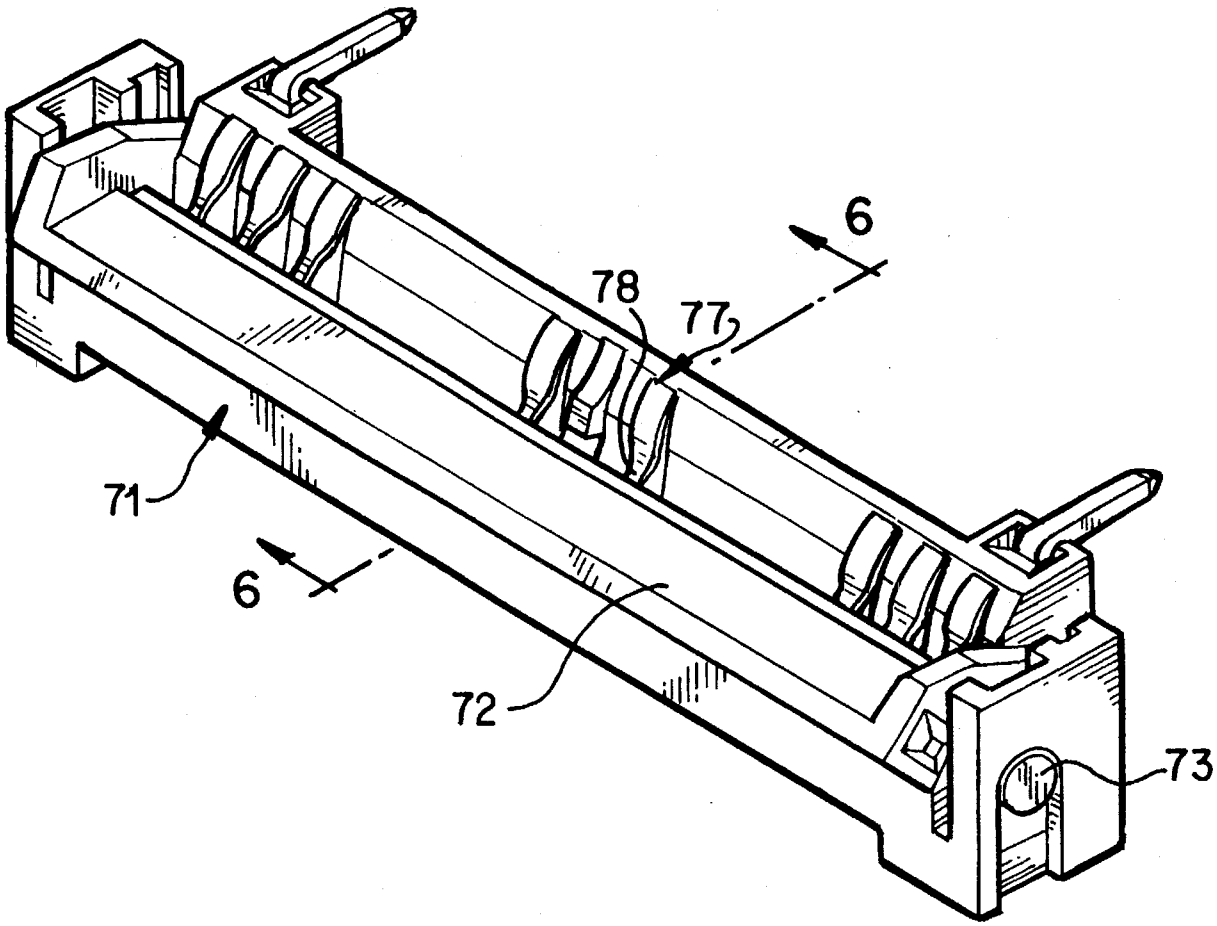
FIG. 5 PRIOR ART
FIG. 5 is a perspective view of still another conventional electrical connector.
Figure 7:
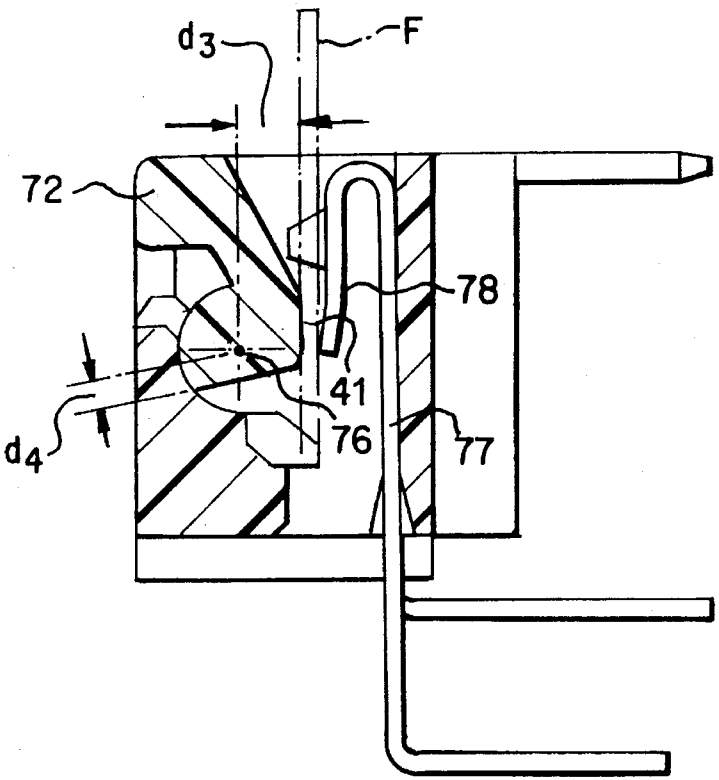
FIG. 7 PRIOR ART
FIG. 7 is a sectional view similar to FIG. 6, wherein the pressure member is in the open position.
Figure 6:
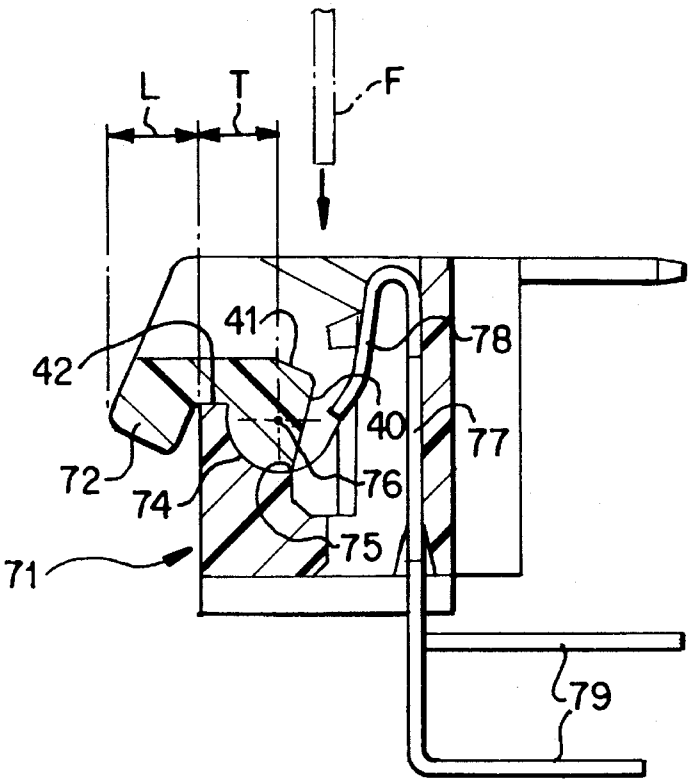
FIG. 6 PRIOR ART
FIG. 6 is a sectional view taken along line 6—6 of FIG. 5.
Figure 8:
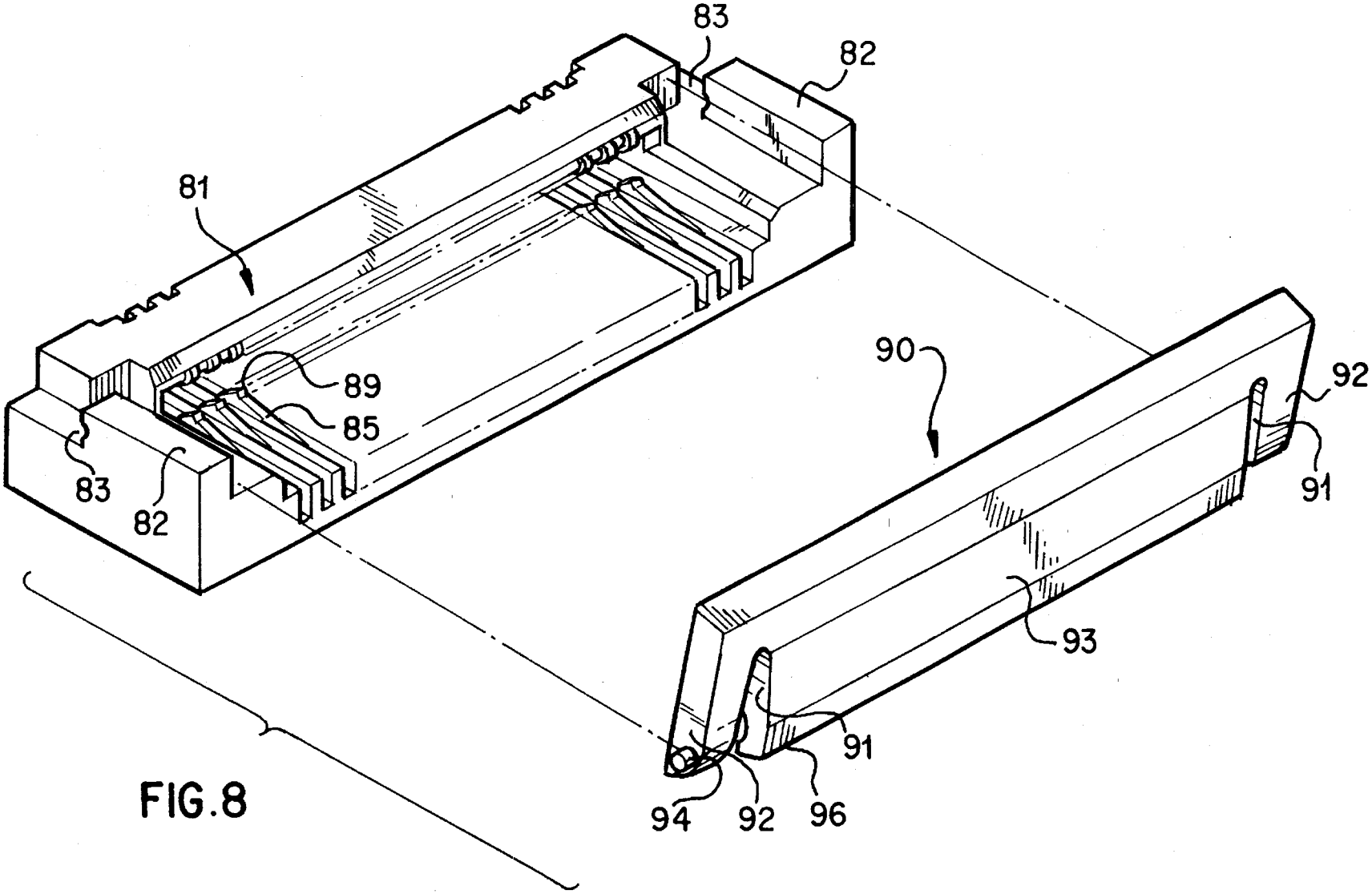
FIG. 8 is a exploded perspective view of an electrical connector according to an embodiment of the invention.
Figure 9:
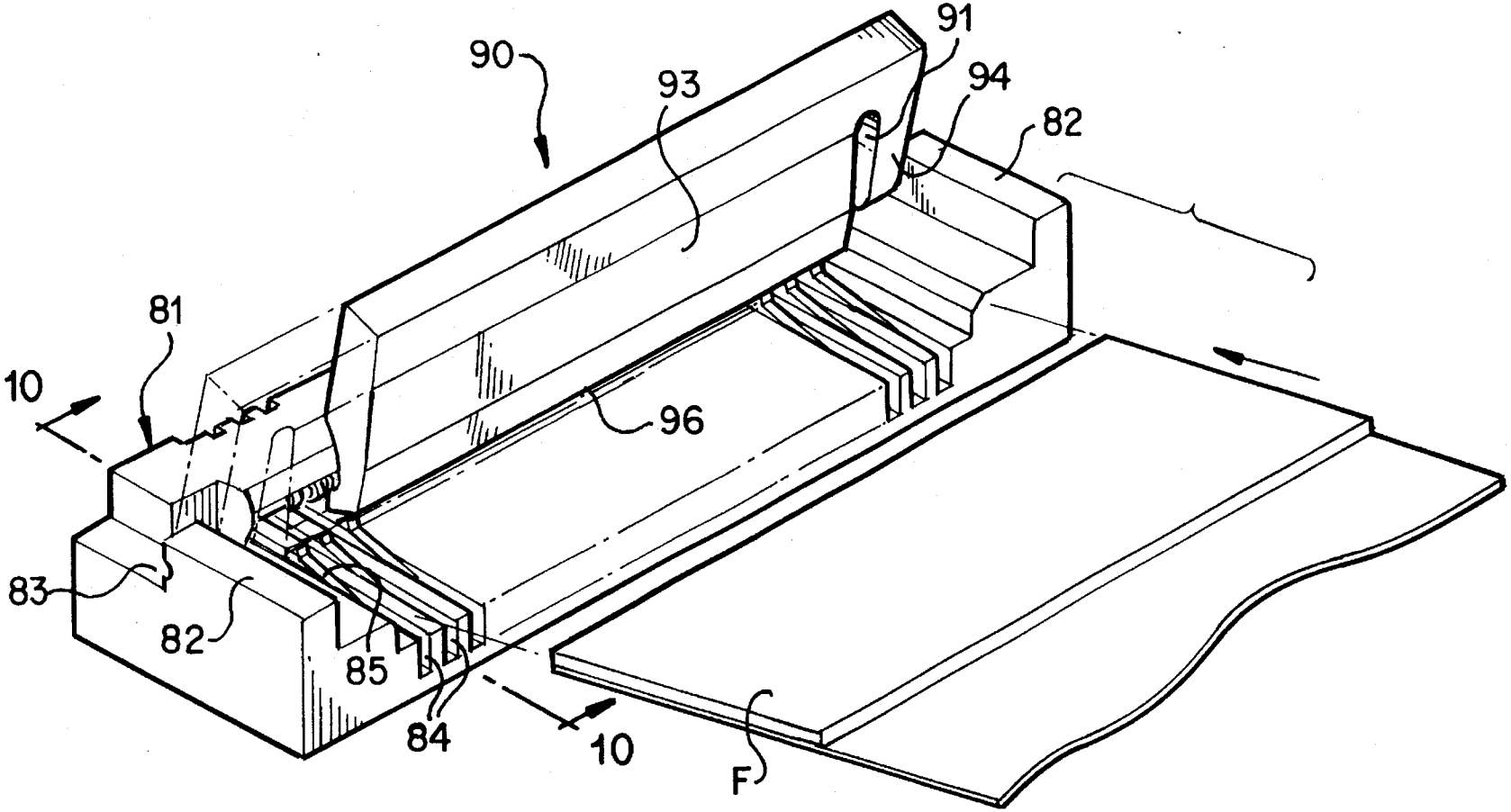
FIG. 9 is a partially cutaway perspective view of the electrical connector of FIG. 8.

In FIGS. 8 and 9, a housing 81 is made from an insulating material so as to have an opening on the upper right-hand corner. A pair of support members 82 extend upwardly from opposite ends of the housing 81. A pair of semi-circular bearing recesses 83 are formed on the rear sides of the support members 82. A number of contact channels 84 are formed at regular intervals on the housing 81 between the support members 82 to receive contact elements 85.

Figure 10:
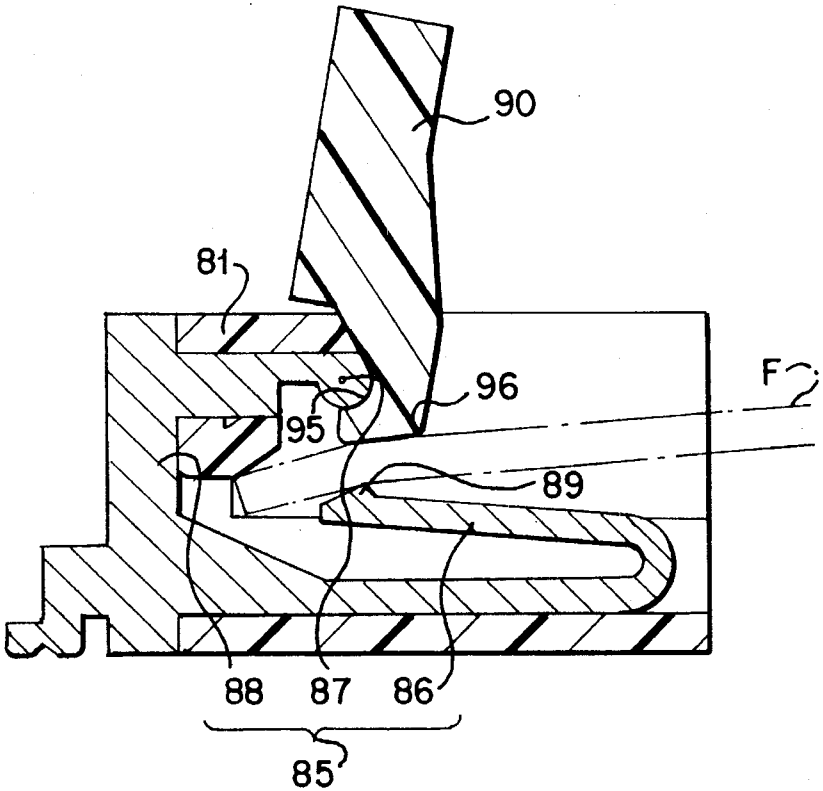
FIG. 10 is a sectional view taken along line 10—10 of FIG. 9.

In FIG. 10, the contact elements 85 are made by stamping a metal sheet to have a U-shaped contact finger 86, a substantially circular fulcrum portion 87, and a link portion 88 for coupling these members 86 and 87. A contact point 89 is formed on the tip of the contact finger 86 so as to face the fulcrum portion 87. The center of the fulcrum portion 87 is aligned to those of the bearing recesses 83.

A pressure member 90 is attached to the housing 81 for rotation to cover the opening. A pair of recesses 91 are provided on opposite ends of the pressure member 90 to form a pair of support arms 92 and a pressure section 93. A pair of shaft portions 94 are provided on the support arms 92 to extend outwardly in the longitudinal direction of the pressure member 90. The radius of the shaft portions 94 is substantially equal to that of the bearing recesses 83. As best shown in FIG. 10, a bearing groove 95 of a semi-circular cross section is formed on the upper surface of the pressure section 93 so as to engage a row of fulcrum portions 87 of contact elements 85 when the shaft portions 94 are fitted in the bearing recesses 83. Since the fulcrum portions 87 are made from metal, the shaft-like body made of fulcrum portions 87 is very strong.

A pressure edge 96 is formed on the lower surface of the pressure section 93 opposite to the bearing groove 95. The pressure edge 96 is sized such that when the pressure member 90 is turned clockwise about the shaft portions 94 and the bearing groove 95, the pressure edge 96 exerts a pressure on the flexible board F which has been placed on the contact fingers 86 of contact elements 85. The pressure edge 96 is located such that it moves from the outside area into the inside area passing a line including the center of the fulcrum portion 87 and the contact point 89 of a contact element 85 as the pressure member 90 rotates from the open position to the closed position where the pressure member 90 is disposed in the vicinity of the flexible board F.

How to connect a flexible board to the electrical connector will now be described below.

(81) The pressure member 90 is turned to the open position to make an open space above the contacts elements 85 as shown in FIG. 10, and a flexible board F is inserted between the pressure member 90 and the contact portions 89 of the contact elements 85 such that the connecting area of the flexible board F faces downwardly. Under this condition, the pressure edge 96 of the pressure member 90 is located on the outside of the line including the center of the fulcrum portion 87 and the contact portion 89 of a contact element 85.

Figure 11:
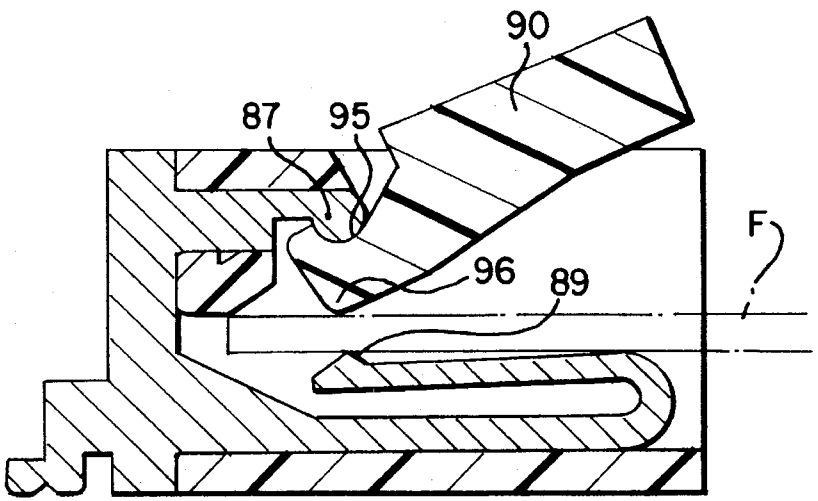
FIG. 11 is a sectional view of the electrical connector of FIG. 8 with the pressure member being turned.

(2) The pressure member 90 is then turned clockwise as shown in FIG. 11 so that the pressure edge 96 of the pressure member 90 comes into contact with the flexible board F and presses the board F against the contact portions 86 of the contact elements 85. The pressure on the flexible board F by the pressure edge 96 takes the maximum value when the pressure edge 96 reaches the line including the center of the fulcrum portion 87 and the contact portion 86 of the contact element 85.

Figure 12:
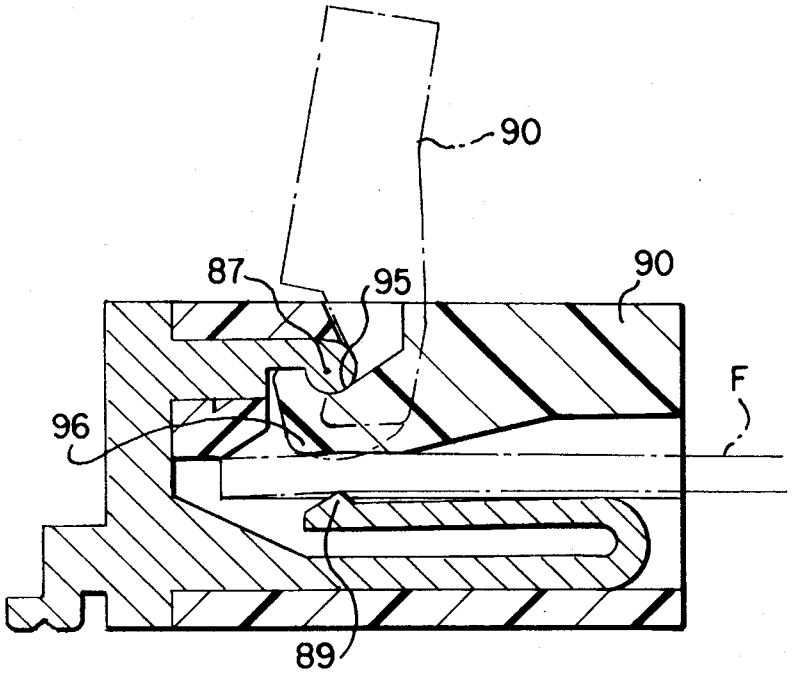
FIG. 12 is a sectional view of the electrical connector of FIG. 8 with the pressure member turned to the closed position.

(3) As the pressure member 90 is being turned to the closed position in FIG. 12, the pressure edge 96 passes the line moving into the inside area while reducing the pressure. Under this condition, the pressure of the pressure member 90 on the flexible board F is slightly lower than the maximum value but sufficiently large to hold the connection between the flexible board F and the contact elements 85.

(4) Even if the reactive force or the pulling force is applied to the flexible board F tending to turn the pressure member 90 counterclockwise or toward the open position, such movement is prevented because the pressure of the pressure edge 96 against the flexible board increases as the pressure edge 96 moves toward the aforementioned line. Thus, the connection is held unless an external force exceeding such a preventive force is applied to the pressure member.

Figure 13:
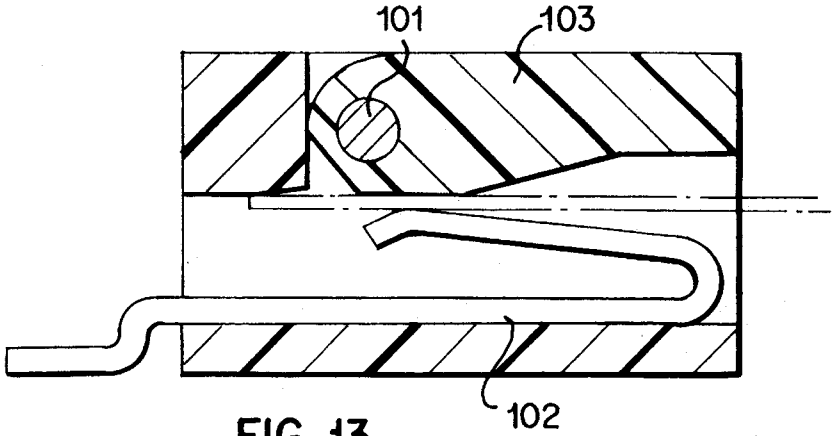
FIG. 13 is a sectional view of an electrical connector according to another embodiment of the invention.

In FIG. 13, a metal bar 101 replaces the fulcrum portions 87 of contact elements 85 in the above embodiment and is formed separately from contact elements 102. The metal bar 101 extends through the aperture of a pressure member 103 and rests on the bearing portions of the housing to support the pressure member 103 for rotation.

Figure 14:
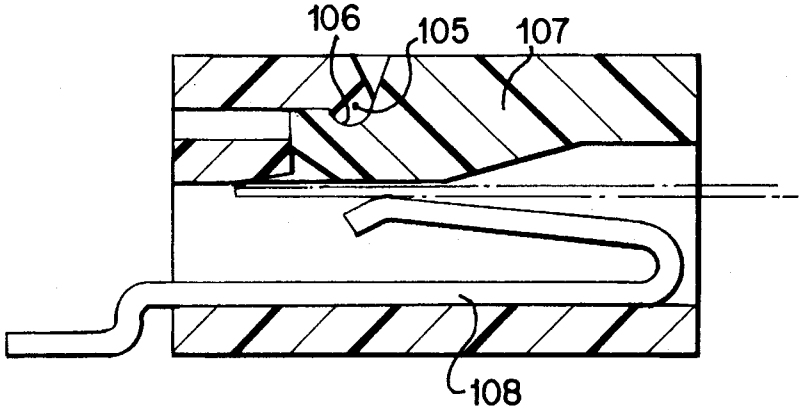
FIG. 14 is a sectional view of an electrical connector according to still another embodiment of the invention.

In FIG. 14, a fulcrum portion 105 is formed on the housing so as to have a semi-circular cross section. The bearing groove 106 of a pressure member 107 engages the fulcrum portion 105 for rotation. This embodiment allows removal of the metal bar 101 in the FIG. 12 embodiment thus reducing the number of parts.

As has been described above, once the pressure member is turned to the closed position, the flexible board is locked in the connection condition, thus preventing accidental disconnection and thus increasing the reliability. Also, it is unnecessary to provide a separate lock mechanism on the connector thereby making the connector simple and compact and high density mounting on a board possible.

Figure 15:
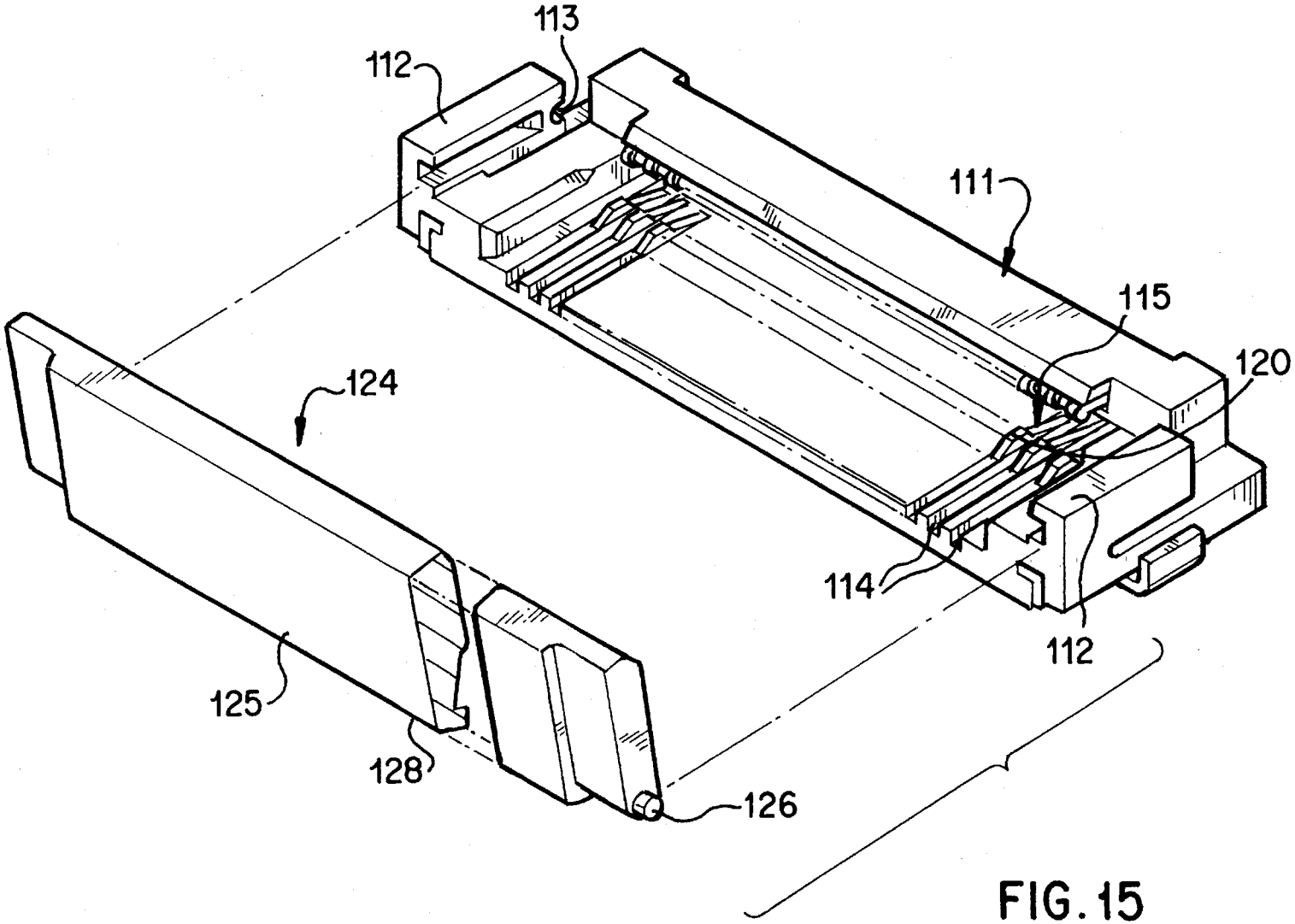
FIG. 15 is an exploded perspective view of an electrical connector according to another embodiment of the invention.
Figure 16:
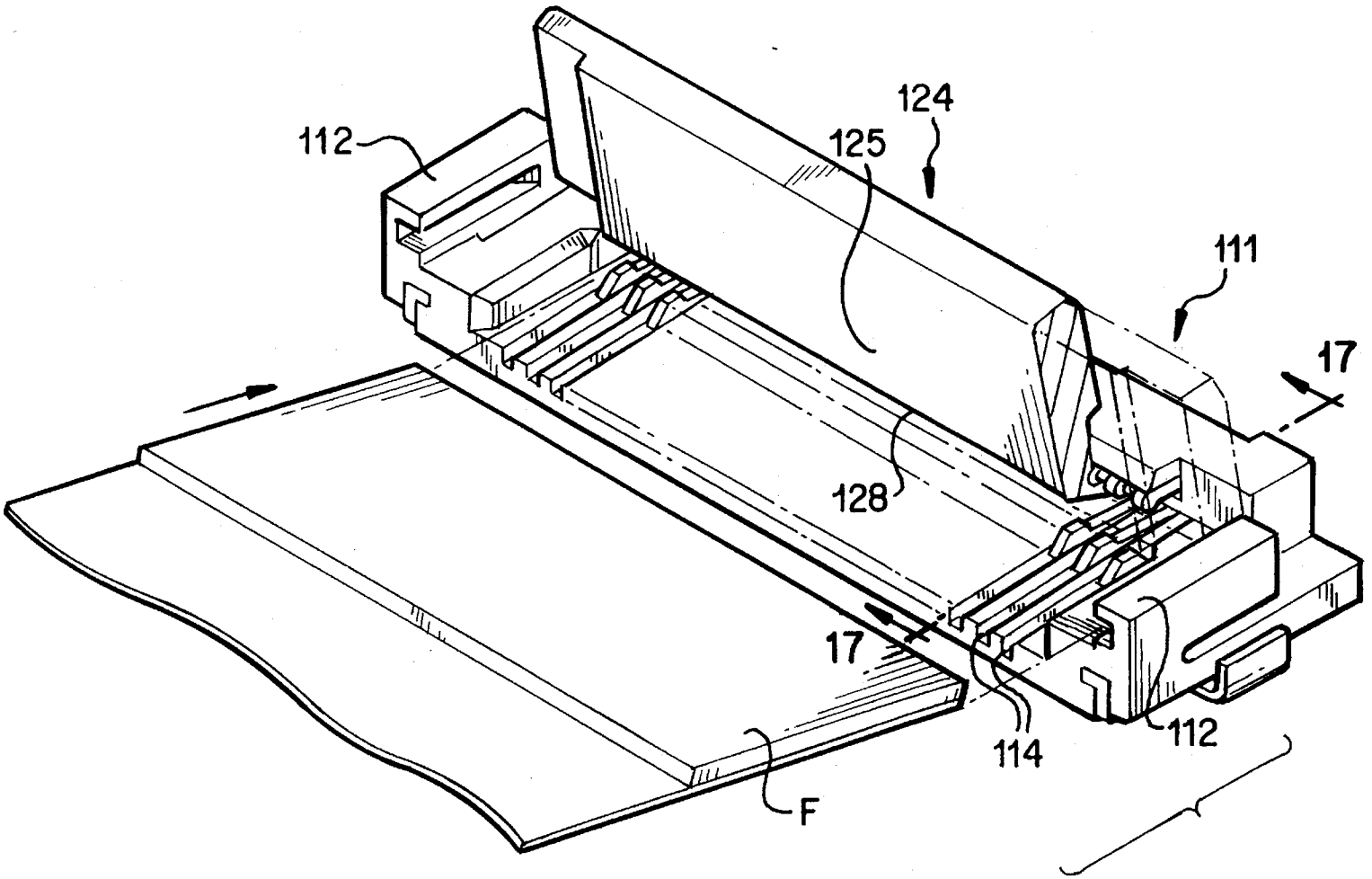
FIG. 16 is a partially cutaway perspective view of the electrical connector of FIG. 15.

In FIGS. 15–16, a housing 111 made from an insulating material has an opening on the upper left corner. A pair of support members 112 extend upwardly from opposite sides of the housing. A semi-circular bearing recess 113 is formed on the rear side of each support member 112. A number of contact channels 114 are formed at regular intervals on the housing 111 between the support members 112 to receive contact elements 115.

Figure 17:
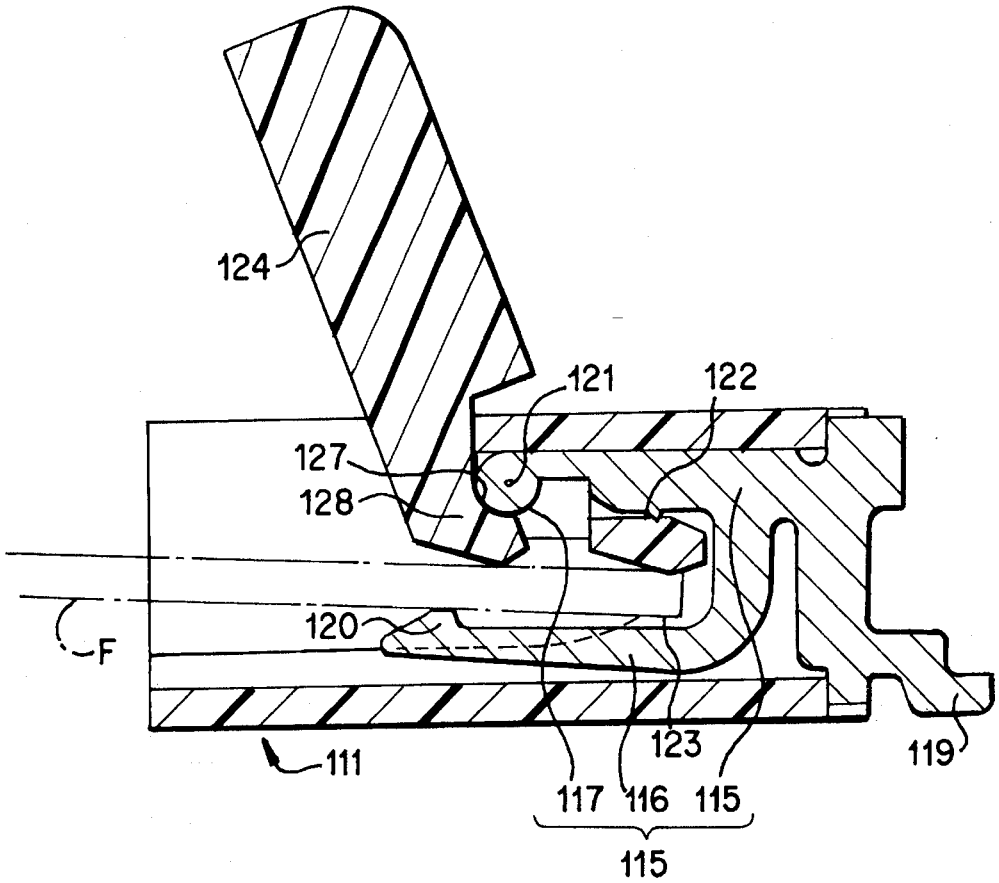
FIG. 17 is a sectional view taken along line 17—17 of FIG. 16.

In FIG. 17, each contact element 115 is made by stamping from sheet metal and formed so as to have a U-shaped contact finger 116, a substantially circular fulcrum portion 117, and a linking portion 118 for linking both the members 116 and 117. A connection portion 119 extends to the right from the linking portion 118 to project from the housing 111 on the substantially same level as the bottom of the housing 111. When the housing 111 is mounted on a circuit board (not shown), the connection portion 119 is brought into contact with a predetermined circuit portion on the circuit board for soldering. A contact portion 120 projects from the tip of a contact finger 116 toward the fulcrum portion 117. The center 121 of the fulcrum portion 117 lies in the same line as the center of the bearing recess 113. The contact elements 115 are press fitted into the contact channels 114 of the housing 111 from the back (right side in FIG. 17). When the contact elements 115 are press fitted in a predetermined position, a barb 122 holds the position.

A support portion 123 extends upwardly from the contact channel 114 to a height slightly greater than the contact fingers of contact elements 115 fitted in the contact channel 114 to support the front portion of the flexible board.

A pressure member 124 is provided in the opening of the housing 111 for rotation to cover the opening. A pressure portion 125 is formed on the pressure member 124. A pair of shaft portions 126 extend outwardly from opposite ends of the pressure member 124. The shaft portions 126 are formed to have a radius substantially equal to that of the semi-circular bearing recesses 113. A bearing groove 127 of a arc cross section is formed on the upper surface of the pressure portion 125 such that when the shaft portions 126 are placed in the bearing recesses 113 of the housing 111 it engages the fulcrum portions 117 of contact elements 115. A row of fulcrum portions 117 of contact elements 115 placed in the contact channels 114 form a shaft-like body on which the bearing groove 127 slides. Since the fulcrum portions 117 are made from metal, the resultant shaft-like body is able to withstand high pressure.

A pressure edge 128 is formed on the side opposite to the bearing groove 127 by two adjacent flat surfaces having different distances from the pivot axis. The location and size of the pressure edge 128 are determined such that when the pressure member 124 is turned counterclockwise, it presses downwardly the flexible board against the support portions 123 of the housing 111 and the contact portions 120 of contact elements 115. Alternatively, the flat surfaces forming the edge may be curved surfaces. The edge may be rounded.

How to connect a flexible board to the electrical connector will now be described below.

(1) As FIG. 17 shows, the pressure member 124 is turned to the open position where the flat surface having a shorter distance from the axis faces the contact elements, and a flexible board F is inserted into a space between the pressure member 124 and the contact portions 120 of contact elements 115 such that the connecting face of the flexible board F faces downwardly. Under this condition, the insertion space is sufficiently large for the flexible board F to be inserted.

Figure 18:
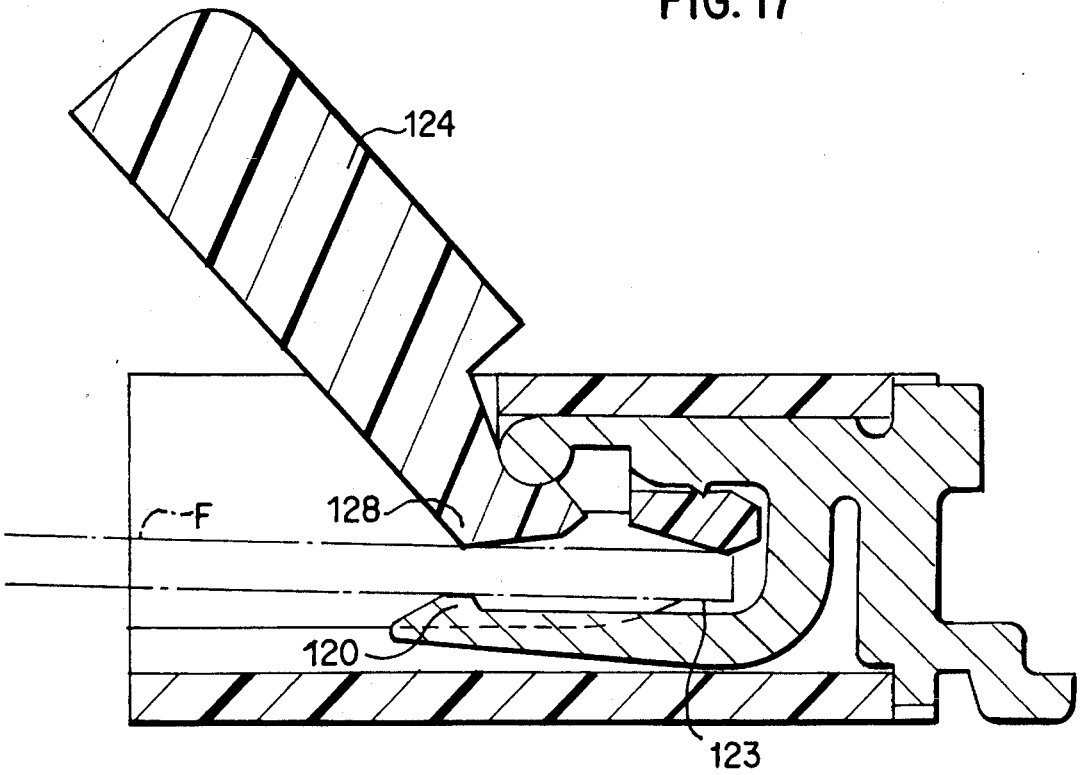
FIG. 18 is a sectional view of the electrical connector wherein the pressure member starts contacting the flexible board.
Figure 19:
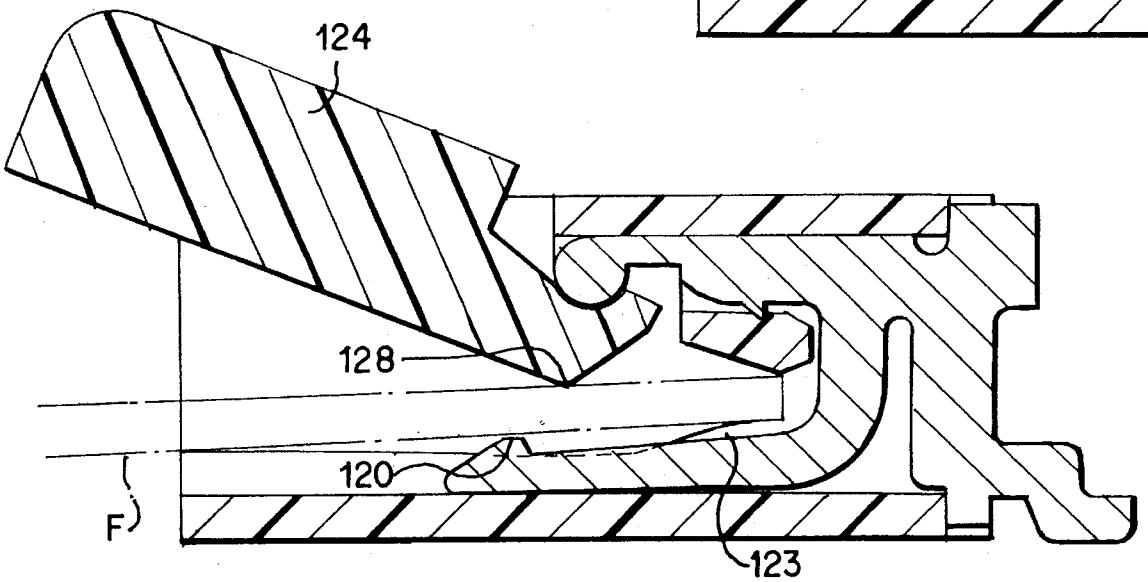
FIG. 19 is a sectional view of the electrical connector wherein the pressure member is pressing the flexible board downwardly.

(2) As FIG. 18 shows, the pressure member 124 is then turned counterclockwise so that the edge 128 of the pressure member 124 comes into contact with the flexible board F starting to depress the flexible board F against the contact portions 120 of contact elements 115 and the support portions 123 of the housing 111. Consequently, the contact portions 120 of contact elements 115 undergoes elastic deformation and contacts the flexible board F with a certain abutting force as shown in FIG. 19. The pressure on the flexible board F by the pressure edge 128 takes the maximum value when the pressure edge 128 reaches the normal line from the center 121 of fulcrum portion 117.

Figure 20:
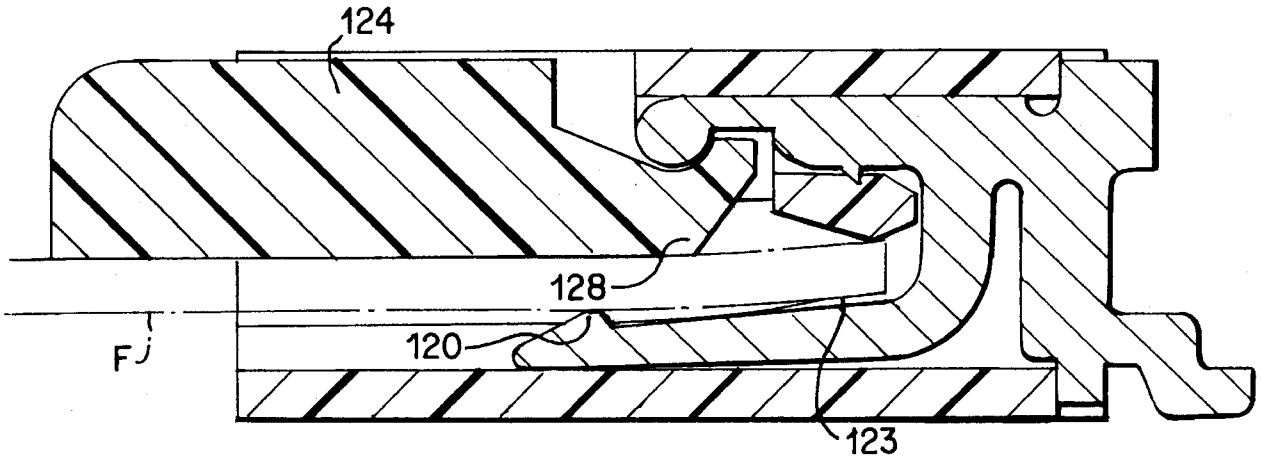
FIG. 20 is a sectional view of the electrical connector wherein the pressure member is in the closed position.

(3) As the pressure member 124 is further turned, the pressure edge 128 is brought into the interior of the housing 111 while exerting decreasing pressure. In the end, the pressure member 124 is brought into the closed position as shown in FIG. 20. Under this condition, the pressure on the flexible board F is slightly less than the maximum value but sufficiently large to hold the connection between the flexible board F and the contact elements 115.

(4) If a pulling force is applied to the flexible board F tending to turn the pressure member 124 clockwise to the open position, the pressure member 124 does not readily open because the pressure edge 128 is located more inside than the turning center so that the reactive force of the flexible board F produces a moment which tends to close the pressure member 124. Consequently, the connection is held unless an external force exceeding the resisting force is applied to the pressure member.

Alternatively, the fulcrum portions of contact elements may be formed separately from the contact elements.

As has been described above, once the pressure member is turned to the closed position, the flexible board is not accidentally disconnected, thus increasing the reliability. Since it is unnecessary to attach any separate lock devices on the sides of a connector, it is possible to make the connector simple and compact, thus meeting the requirement for recent high density mounting design. The distance between the contact portions of contact elements and the support portions of a housing is sufficiently long to provide a moment, making connector miniaturization possible without hindering insertion of a flexible board. Since the pressure edge of a pressure member exerts a pressure on a position between the above two supporting locations, the flexible board undergoes warping deformation to provide constant contact regardless of divergence in precision of location and size of respective parts.

Figure 21:
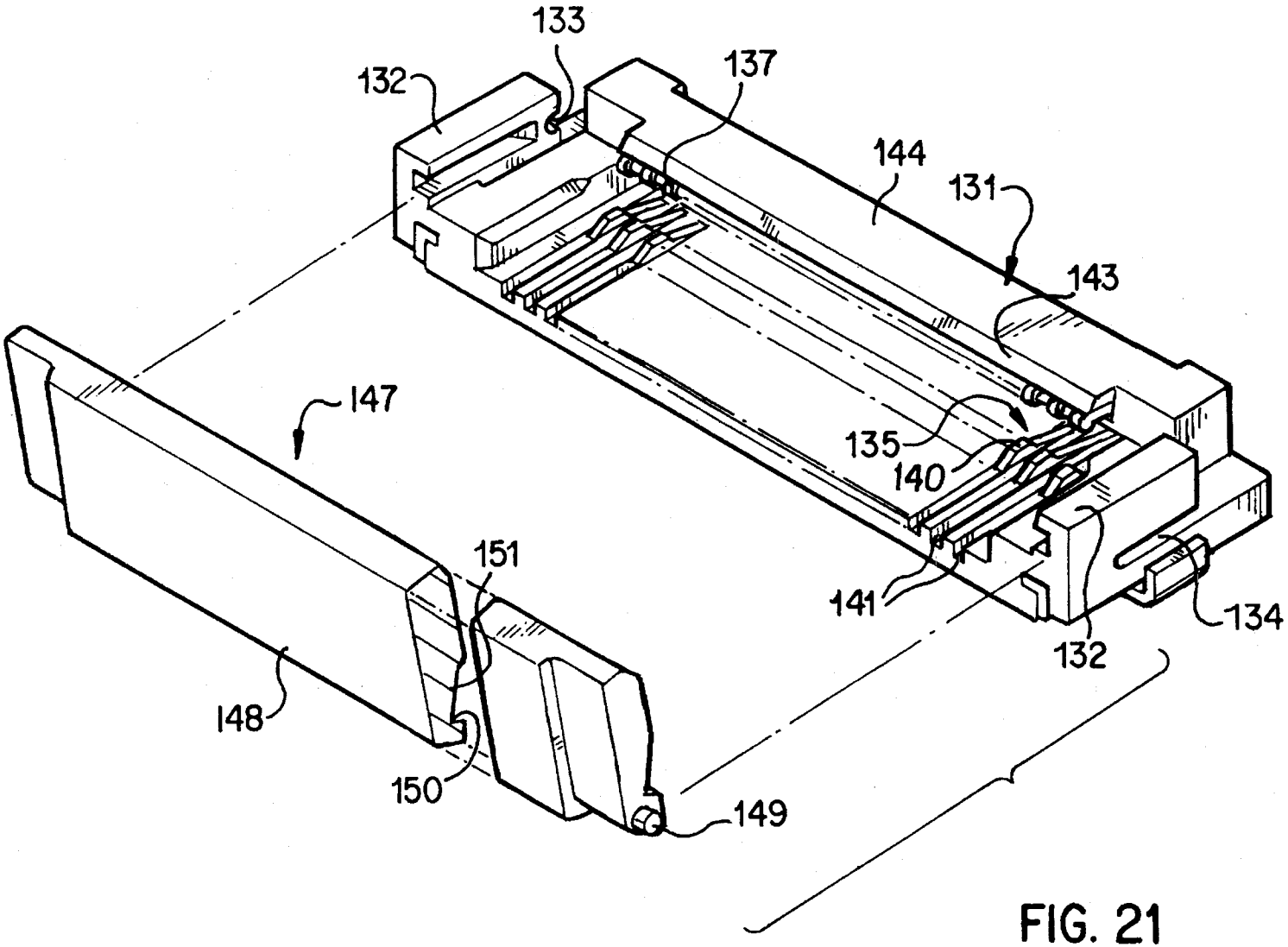
FIG. 21 is an exploded perspective view of a flexible board electrical connector according to a still another embodiment of the invention.
Figure 22:
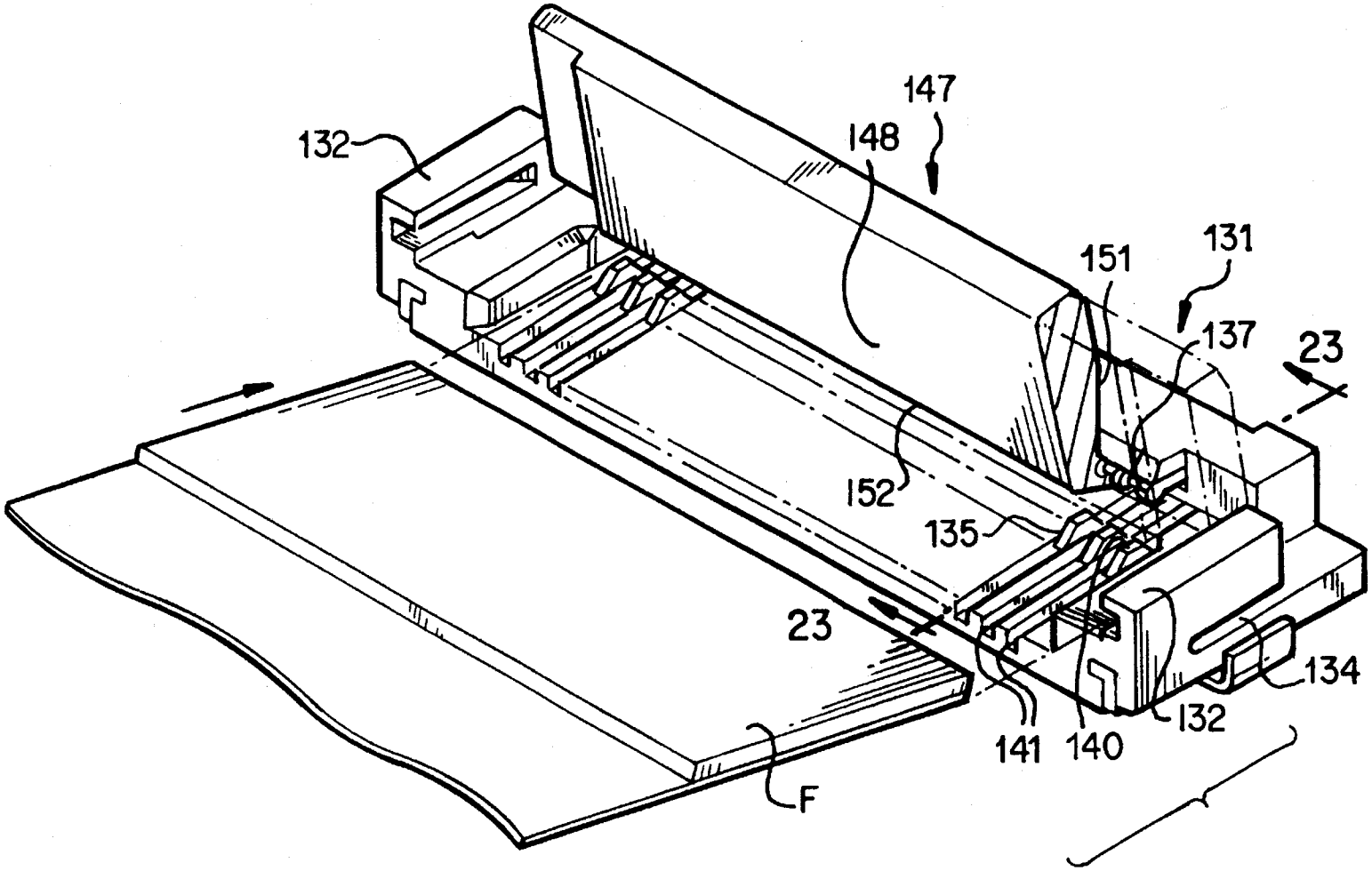
FIG. 22 is a partially cutaway perspective view of the flexible board electrical connector of FIG. 21.

In FIGS. 21 and 22, a housing 131 is made from an insulating material so as to have an opening on the upper left side. A pair of support members 132 are provided on opposite sides of the opening. A pair of bearing recesses 133 having a semi-circular section are provided on the rear faces of the support members 132. A pair of recesses 134 are provided on the lower portions of the support members 132 to cantilever the support members 132 so that when subjected to upward forces, the bearing recesses 133 are somewhat movable upwardly.

Figure 23:
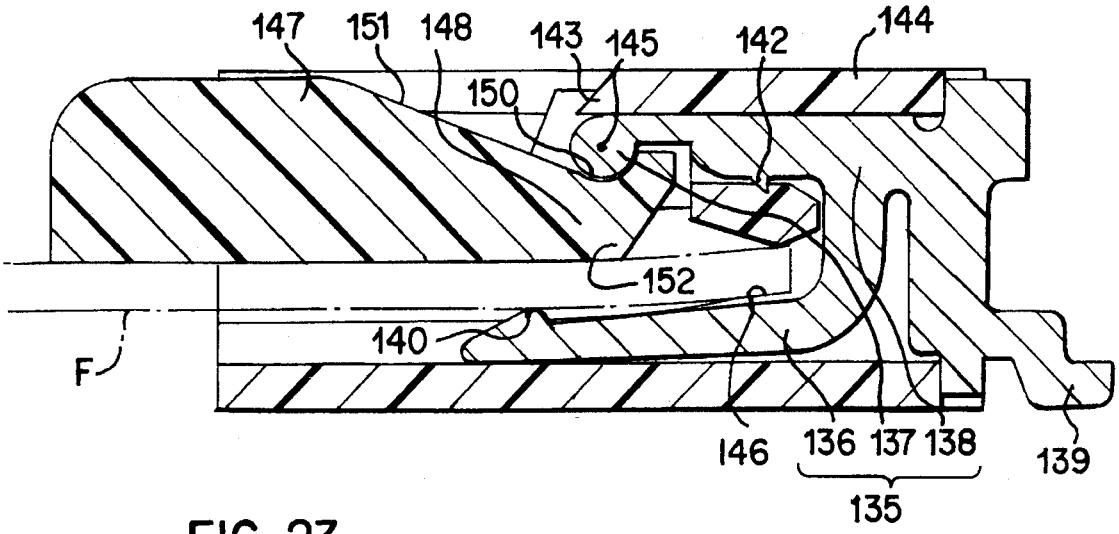
FIG. 23 is a sectional view taken along line 23—23 of FIG. 22.

In FIG. 23, the contact elements 135 are made by stamping sheet metal so as to provide a contact finger 136, a fulcrum portion 137, and a linking portion 138 for linking both the sections 136 and 137. A connection portion 139 extends to the right from the linking portion 138 and projects from the housing 131 on substantially the same level as the bottom of the housing 131 so that when the housing 131 is mounted on a circuit board (not shown), the connection portions 119 are brought into contact with the circuit conductors of the circuit board for soldering. A contact point 140 is provided on the front portion of a contact finger 136 so as to face the fulcrum portion 137. The center 145 of the fulcrum portion 137 lies in the same line as the center of the bearing recess 133 of the housing 131. The contact elements 135 are press fitted into contact channels 141 of the housing 131 from the back and held in place by barbs 142 of the contact element 135. When the contact elements 135 are held in place in the contact channels 141, the fulcrum portions 117 are positioned to slightly project forwardly from the front edge 143 of the ceiling 144 of the housing 131. The front edge 143 of the ceiling 144 is tapered toward outside.

A support portion 146, which is slightly higher than the contact finger 136 of a contact element 115, is provided on the wall of a contact channel 141 so that when a flexible board is inserted, it pushes upwardly the front portion of the flexible board.

A pressure member 147 is attached to the housing 131 for rotation to cover the opening. A pressure section 148 is provided on the pressure member 147, and a pair of shaft portions 149 extend outwardly from opposite ends of the pressure section 148 and are supported by the bearing recesses 133 of the housing 131 for rotation. The shaft portions 149 have a radius substantially equal to that of the bearing recesses 133 of the housing 131. A bearing groove 150 having an arc cross section is provided on the upper surface of the pressure section 148 so as to engage the fulcrum portions 137 of a row of contact elements 135 when the shaft portions 149 are placed in the bearing recesses 133. When the row of contact elements 135 are fitted in the contact channels 141, the fulcrum portions 137 are arranged to form a combed shaft-like body on which the bearing groove 150 of the pressure member 147 slides. Consequently, the pressure member 147 is supported by the bearing recesses 133 and the fulcrum portions 137 which are made of metal so that they are very resistant to deformation from the axis. A sloping face 151 extends from the bearing groove 150 and abuts on the front face 143 of the housing 131 at an angle more than 90° when the pressure member 147 is opened.

A pressure edge 152 is formed on the lower surface of the pressure member 147 by a pair of adjoining flat surfaces which have different distances from the axis. The location and size of the pressure edge 152 are determined such that when the pressure member 147 is turned counterclockwise to the closed position, it applies a pressure to the upper surface of a flexible board F at a position between the contact portions 140 of contact elements 135 and the support portions 146 of the housing 131. Alternatively, the flat surfaces forming the pressure edge 152 may be curved surfaces. The pressure edge may be rounded.

How to connect a flexible board to the electrical connector will now be described below.

Figure 24:
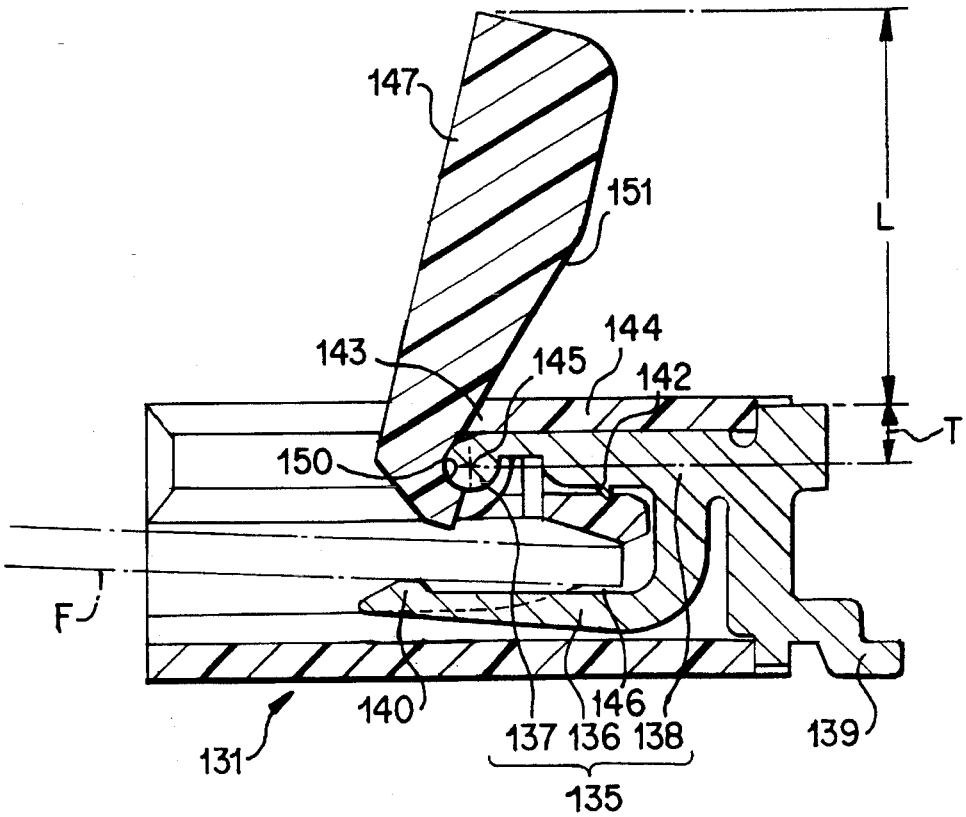
FIG. 24 is a sectional view wherein the pressure member abuts against the front edge of a housing.

(1) As shown in FIG. 24, the pressure member 147 is turned clockwise to the open position, and a flexible board F is inserted into a space between the pressure member 147 and the contact portions 140 of a contact elements 135 such that the connecting side of the flexible board F faces downwardly. Under this condition, the opening of the insertion space is sufficiently large for the thickness of the flexible board F.

(2) As shown in FIG. 23, the pressure member 147 is then turned counterclockwise to the closed position. Consequently, the pressure edge 152 presses downwardly the flexible board F at a position between the contact portions 140 of contact elements 135 and the support portions 146 of the housing 131 so that the flexible board F undergoes a relatively large elastic deformation and contact the contact portions 140 with the abutting pressure. The pressure on the flexible board F by the pressure edge 152 takes the maximum value when the pressure edge 152 reaches the normal line including the center 145 of the fulcrum portions 137.

(3) In order to replace the flexible board F with a new one, the pressure member 147 is turned clockwise to the open position as shown in FIG. 24. The pressure member 147 is supported by the bearing groove 150 and the shaft portions 149 for rotation and the sloped surface 151 abuts on the front face 143 of the housing 131. The arm length of the moment is the distance L between the front face 143 and the front edge of the pressure member 147, as shown in FIG. 24, which is so large that a large moment is produced.

Figure 25:
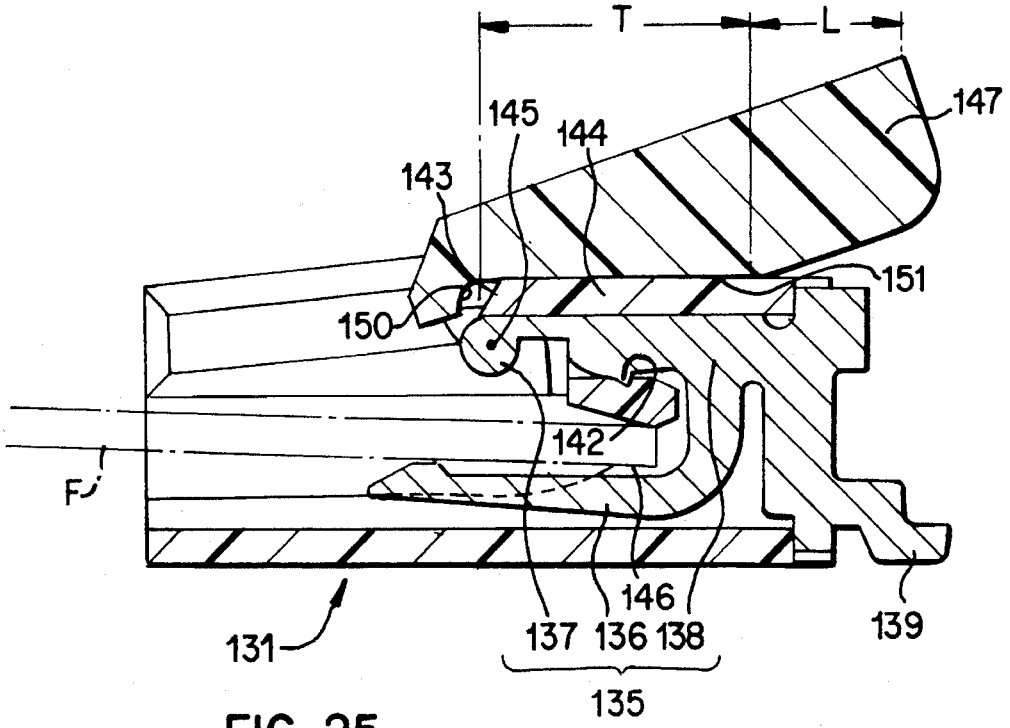
FIG. 25 is a sectional view wherein the pressure member abuts on the upper surface of the housing.

(4) If the operator still applies the large moment to the pressure member 147 after the pressure member 147 abuts the housing 131, the moment is applied to the shaft portions 149 to bend upwardly the support members 132 as shown in FIG. 25. Consequently, the bearing groove 150 of the pressure member 147 is comes off from the fulcrum portions 137 so that the sloping surface 151 of the pressure member 147 abuts the upper surface of the housing 131. The arm length of the moment at this point is the distance L between the end of the sloping surface 151 and the front end of the pressure member 147 which is very small. As a result, the moment for turning the pressure member 147 is so small that the shaft portions 149 are protected from being broken.

Figure 26:
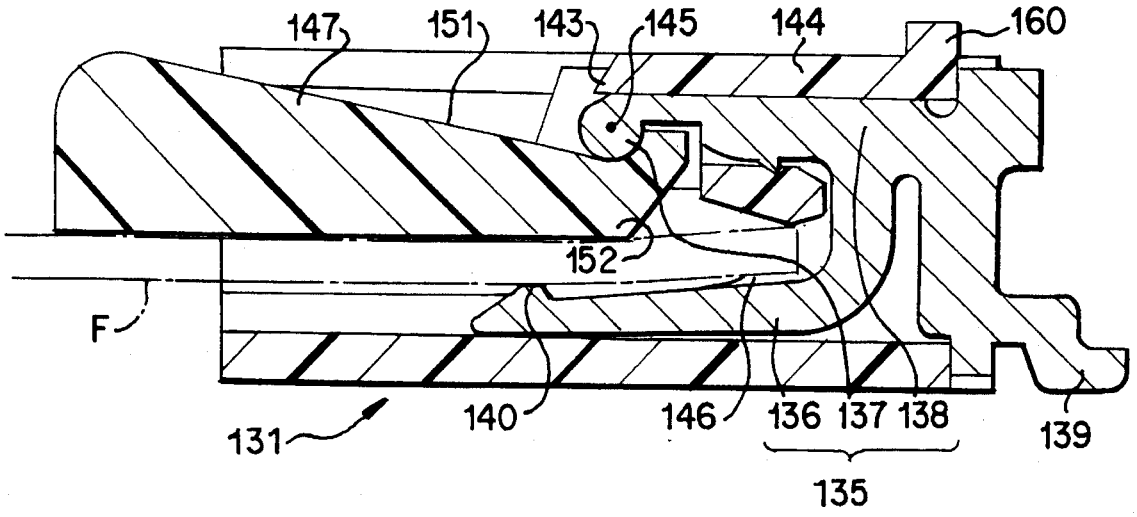
FIG. 26 is a sectional view showing a variation of the embodiment shown in FIG. 23.
Figure 27:
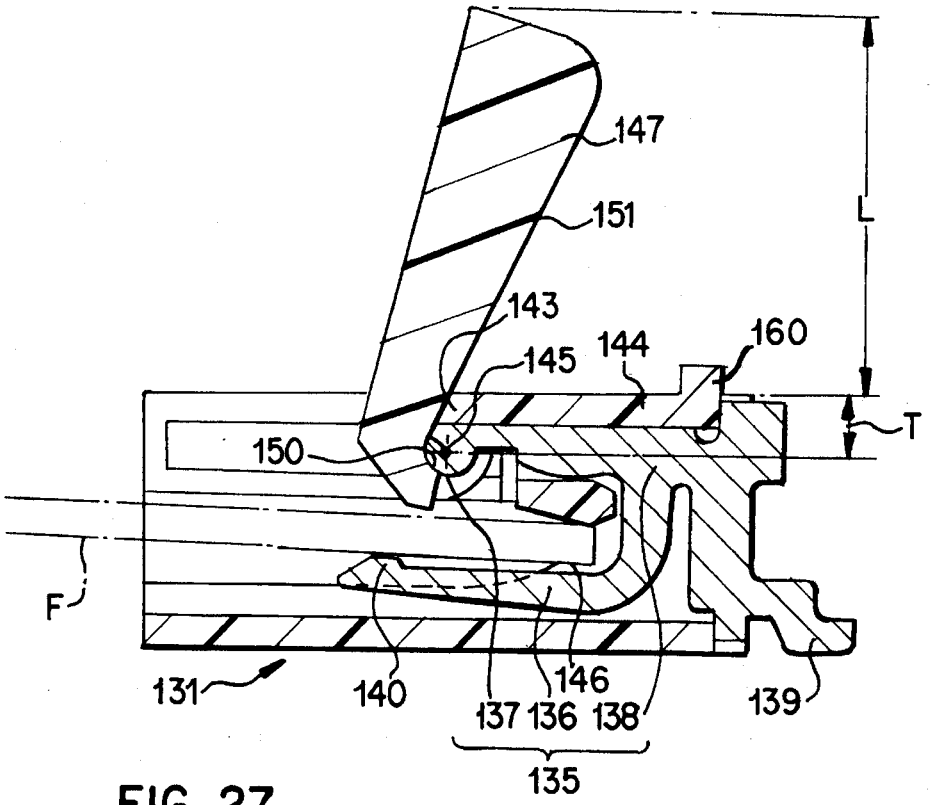
FIG. 27 is a sectional view wherein the pressure member of FIG. 26 abuts against the front edge of a housing.
Figure 28:
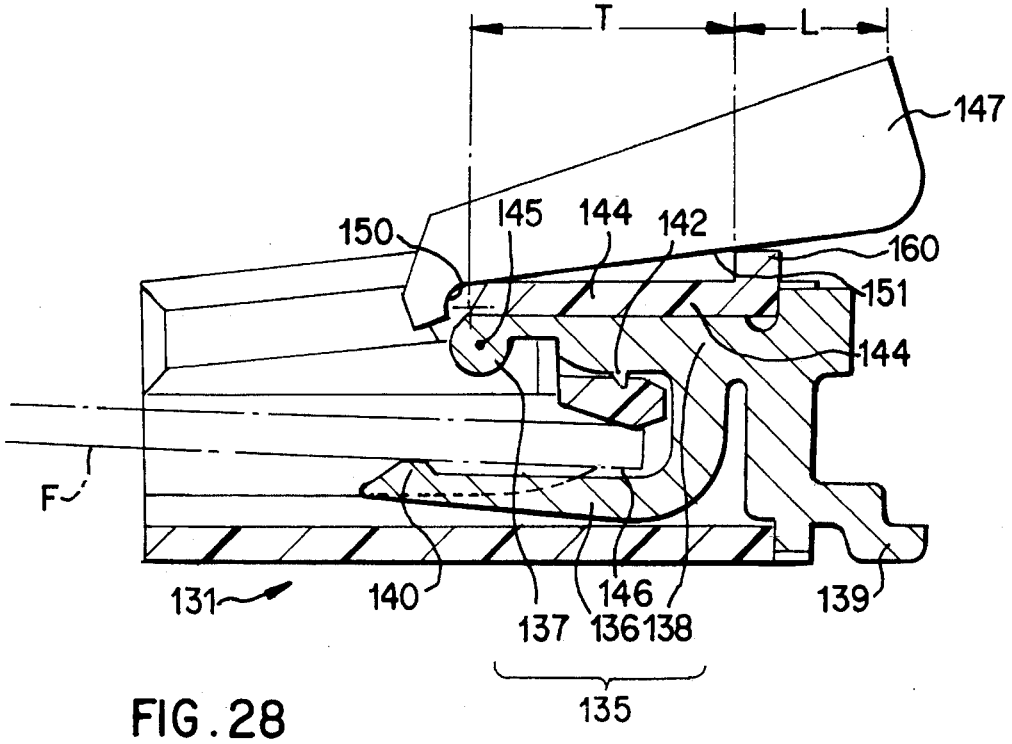
FIG. 28 is a sectional view wherein the pressure member of FIG. 26 abuts on the upper surface of the housing.
Figure 29:
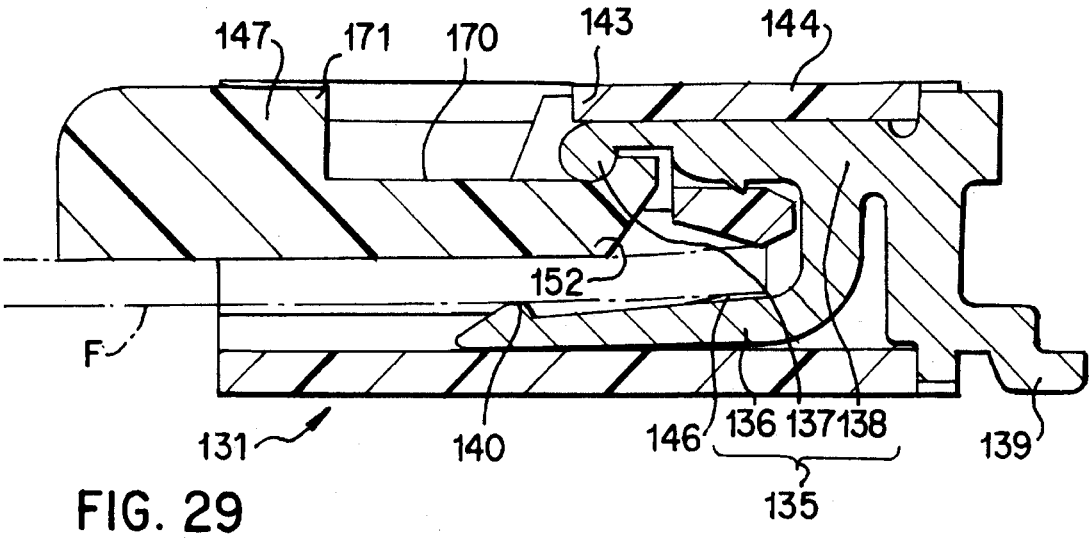
FIG. 29 is a sectional view showing another variation of the embodiment shown in FIG. 23.
Figure 30:
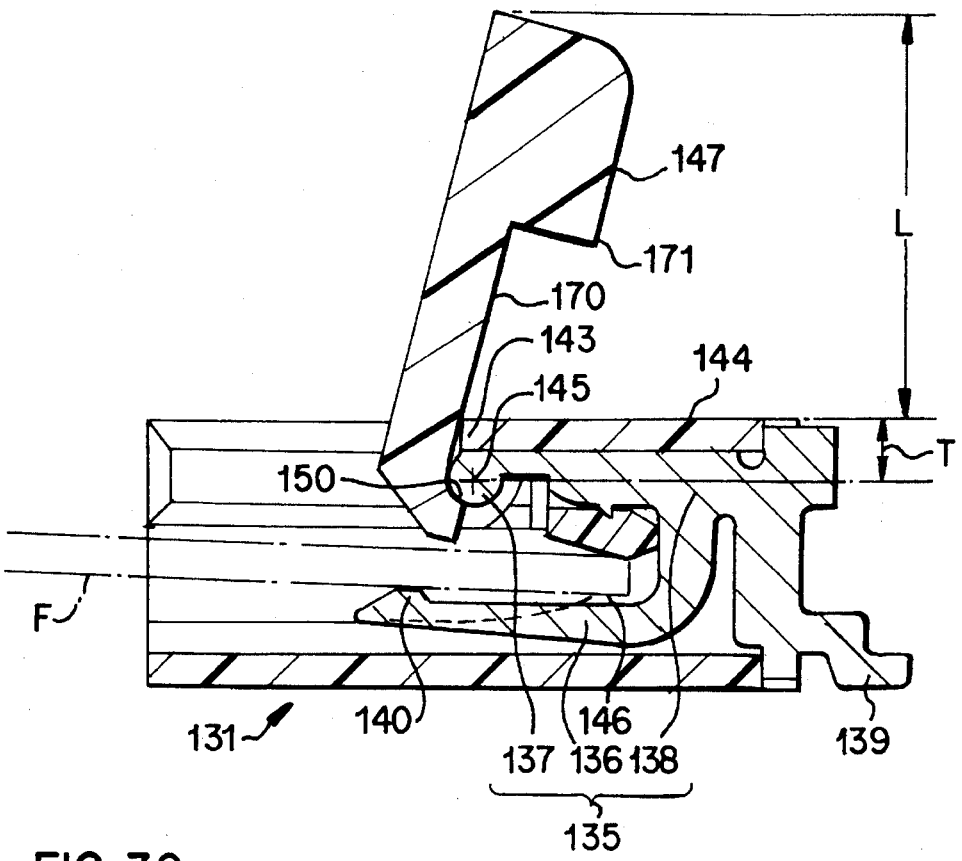
FIG. 30 is a sectional view wherein the pressure member of FIG. 29 abuts against the front edge of a housing.
Figure 31:
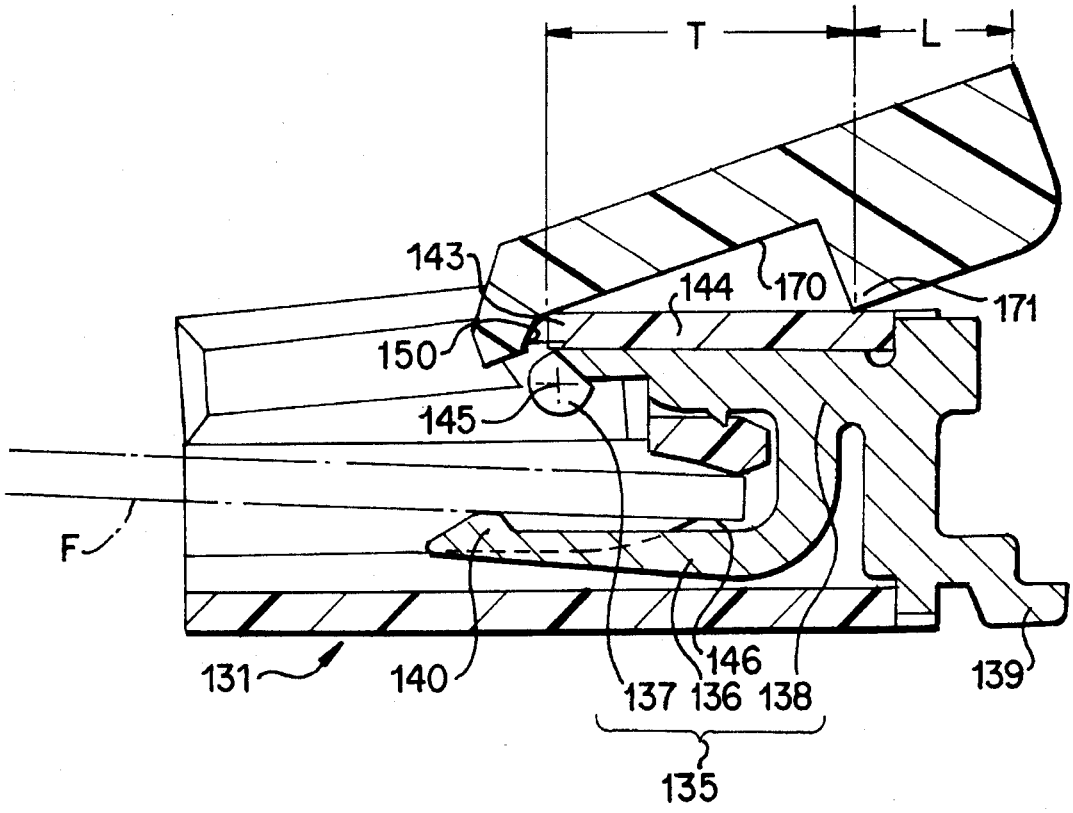
FIG. 31 is a sectional view wherein the pressure member of FIG. 29 is abuts on the upper surface of the housing.

In FIG. 26, a projection 160 is provided on the upper surface of the housing 131. When turned as shown in FIG. 27, the sloping surface 151 abuts against the projection 160 as shown in FIG. 28. Alternatively, as shown in FIG. 29, a recess 170 extending from the bearing groove 150 may be provided on the pressure member 147 to form a shoulder 171. When turned clockwise as shown in FIG. 30, the shoulder 171 abuts against the upper surface of the housing 131 as shown in FIG. 31. In these embodiments, the distance L between the projection 160 or the shoulder 171 and the front end of the pressure member 147 is so small that the moment tending to turn the pressure member 147 becomes small.

As has been described above, the bearing groove 150 comes off from the fulcrum portions 137 as the support members 132 are bent by the shaft portions 149 after the pressure member 147 abuts on the front surface 143 of the housing 131 but, alternatively, the upper surface of the housing 131 may be made abutted against a series of flat or curved surfaces of the pressure member 147 which is increasingly apart from the shaft portions.

As has been described above, the abutting location between the and the pressure member is away from the axis as the pressure member is turned to the open position, so that the torque for turning the pressure member decreases with the rotation of the pressure member thereby preventing damage to the support members. In addition, the support members undergoes elastic deformation under the torque produced by the abutting of the pressure member on the so that it is possible to shift the abutting location to large extent thus preventing damage to the support members more effectively than ever before.

We claim:

1. An flexible board electrical connector comprising:

a substantially rectangular housing having an opening on an upper corner, a pair of support members on opposite sides of said opening, and a plurality of support channels between said support members;

a plurality of contact elements fitted in said support channels in said opening such that spring contact portions thereof are exposed in said opening;

a pressure member supported by said support member for rotation about a turning center between a closed position where it is brought into a vicinity of said contact elements and an open position where it is apart from said contact elements;

a pressure edge provided on said pressure member at such a position that when said pressure member is in said open position, said pressure edge is in a first position which is outside of a line drawn from said turning center of said pressure member to said contact portions of contact elements and when said pressure member is turned to said closed position, said pressure edge is moved to a second position which is inside of said line such that said pressure edge presses downwardly a flexible board against said contact elements, wherein said contact elements are provided with a fulcrum portion to be fitted in said support channels, about which said pressure member is turned.

2. The flexible board electrical connector of claim 1, wherein said pressure edge is formed with a pair of adjoining flat surfaces having different distances from said turning center.

3. The flexible board electrical connector of claim 1, which further comprising a plurality of support portions provided on said housing at a position more interior to said contact portions of said contact elements to support a front portion of said flexible board so that when said pressure member is turned to said closed position, said support portions and said contact portions support said flexible board while said pressure member exerts a pressure on a point between said support portions and said contact portions.

4. The flexible board electrical connector of claim 3, wherein said contact elements have a flat shape with a fulcrum portion to be fitted into said support channel.

5. The flexible board electrical connector of claim 4, wherein said fulcrum portion has a turning surface interior to said turning center for supporting said pressure members.

6. The flexible board electrical connector of claim 1, which further comprises a sloping face provided on said pressure member on a side opposite to said pressure edge for abutting a front face of said housing at a predetermined angle when said pressure member is turned to said open position and an upper face of said housing which is away from said fulcrum portion when said pressure member is turned further beyond said predetermined angle.

7. The flexible board electrical connector of claim 6, wherein said pressure member is provided on an upper surface thereof with a bearing groove which comes off from said fulcrum portion when said sloping face abuts said housing while said support members undergoes elastic deformation due to turning of said pressure member beyond said predetermined angle thereby allowing a shift of said turning center of said pressure member off from said fulcrum portion.

* * * * *